US005474322A

United States Patent [19]

Perkins et al.

[11] Patent Number: 5,474,322

[45] Date of Patent: Dec. 12, 1995

[54] SNOWBOARD BINDING

[75] Inventors: Richard W. Perkins, Van Nuys; Bradley L. Read, Los Angeles, both of Calif.

[73] Assignee: Crush Snowboard Products, Inc., Van Nuys, Calif.

[21] Appl. No.: 278,511

[22] Filed: Jul. 21, 1994

[51] Int. Cl.[6] ..... A63C 9/02

[52] U.S. Cl. ..... 280/613; 280/618; 280/623; 36/117

[58] Field of Search ..... 280/613, 607, 280/618, 614, 615, 623; 70/170, 175; 36/117, 120, 131

[56] References Cited

U.S. PATENT DOCUMENTS

| | | | |
|---|---|---|---|
| 1,149,981 | 8/1915 | Joseph | 70/170 |
| 1,958,019 | 5/1934 | Reasoner | 70/170 |
| 3,061,325 | 10/1962 | Glass | 280/613 |
| 3,955,825 | 5/1976 | Kubelka et al. | 280/618 |
| 4,021,056 | 5/1977 | Oakes | 280/613 |
| 4,284,292 | 8/1981 | Faulin | 280/613 |
| 4,316,618 | 2/1982 | Sampson | 280/613 |
| 5,044,654 | 9/1991 | Meyer | 280/618 |
| 5,054,807 | 10/1991 | Fauvet | 280/607 |
| 5,156,644 | 10/1992 | Koehler et al. | 280/607 |
| 5,214,865 | 6/1993 | Sartor | 280/613 |
| 5,261,689 | 11/1993 | Carpenter et al. | 280/618 |

FOREIGN PATENT DOCUMENTS

| | | | |
|---|---|---|---|
| 2604913 | 4/1988 | France | 280/613 |

*Primary Examiner*—Margaret A. Focarino
*Assistant Examiner*—Carla Mattix
*Attorney, Agent, or Firm*—Blakely, Sokoloff, Taylor & Zafman

[57] ABSTRACT

A snowboard binding that can readily attach and release a boot from a snowboard. The binding includes a binding housing that is mounted to the snowboard. The housing has a pair of pin holes that receive locating pins which extend from the sole of a boot. When the snowboarder inserts the pins into the holes, a pair of locking pins extend through apertures in the locating pins to secure the boot to the board. The locking pins are coupled to a lever which can be rotated by the user. Rotation of the lever moves the locking pins out of the locating pin apertures so that the boot can be detached from the board. The binding housing includes a base plate that is mounted to the snowboard and a cover plate which contains the locking pins and release mechanism. The cover plate is coupled to the base plate by a tie down bolt which can be unscrewed to allow rotation of the cover plate relative to the board. Rotating the cover plate also rotates the pin holes and the corresponding foot position of the snowboarder.

18 Claims, 5 Drawing Sheets

SNOWBOARD BINDING

BACKGROUND OF THE INVENTION

1. Field of the Invention

The present invention relates to a boot binding for a snowboard.

2. Description of Related Art

Snow ski bindings typically have latching heal components that allow the skier to step into the bindings and become fastened to the skis. The bindings also have release features that unlatch the heel components and allow the boots to be readily detached from the skis.

Snowboarding is conducted on a single relatively wide board. Conventional snowboard bindings typically have a plurality of straps that are mounted to the board and are fastened to the boarder's boots. Because both feet are attached to the snowboard, snowboarders must typically unfasten the binding straps and remove one foot from the board to push themselves onto a chair lift. To slide down a run, the boarder must re-fasten the free boot back onto the board. The constant cycle of unfastening and re-fastening the straps is both time consuming and physically exerting. It would therefore be desirable to provide a snowboard binding that allows the boots to be readily fastened and detached from the board in a manner similar to the operation of a snow ski binding.

Different snow conditions and hill terrain may warrant a different positioning of the snowboarder's feet relative to the board. For example, in powder conditions the boarder may desire parallel foot placement. In icy conditions the boarder may prefer to have his feet rotated in relation to one another, or to the board. With conventional board bindings axial foot placement is varied by moving the entire binding to a new location on the board. The binding is moved to a different location on the board by unscrewing and reattaching a plurality of mounting bolts. Detaching and reassembling bolts requires special tools and can consume valuable ski time. It is therefore desirable to have a snowboard binding that can be readily adjusted to a plurality of different foot positions.

SUMMARY OF THE INVENTION

The present invention is a snowboard binding that can readily attach and release a boot from a snowboard. The binding includes a binding housing that is mounted to the snowboard. The housing has a pair of pin holes that receive locating pins which extend from the sole of a boot. When the snowboarder inserts the pins into the holes, a pair of locking pins extend through apertures in the locating pins to secure the boot to the board. The locking pins are coupled to a lever which can be rotated by the user. Rotation of the lever moves the locking pins out of the locating pin so that the boot can be detached from the board. The binding housing includes a base plate that is mounted to the snowboard and a cover plate which contains the locking pins and release mechanism. The cover plate is coupled to the base plate by a tie down bolt which can be unscrewed to allow rotation of the cover plate relative to the board. Rotating the cover plate also rotates the pin holes and the corresponding foot position of the snowboarder.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
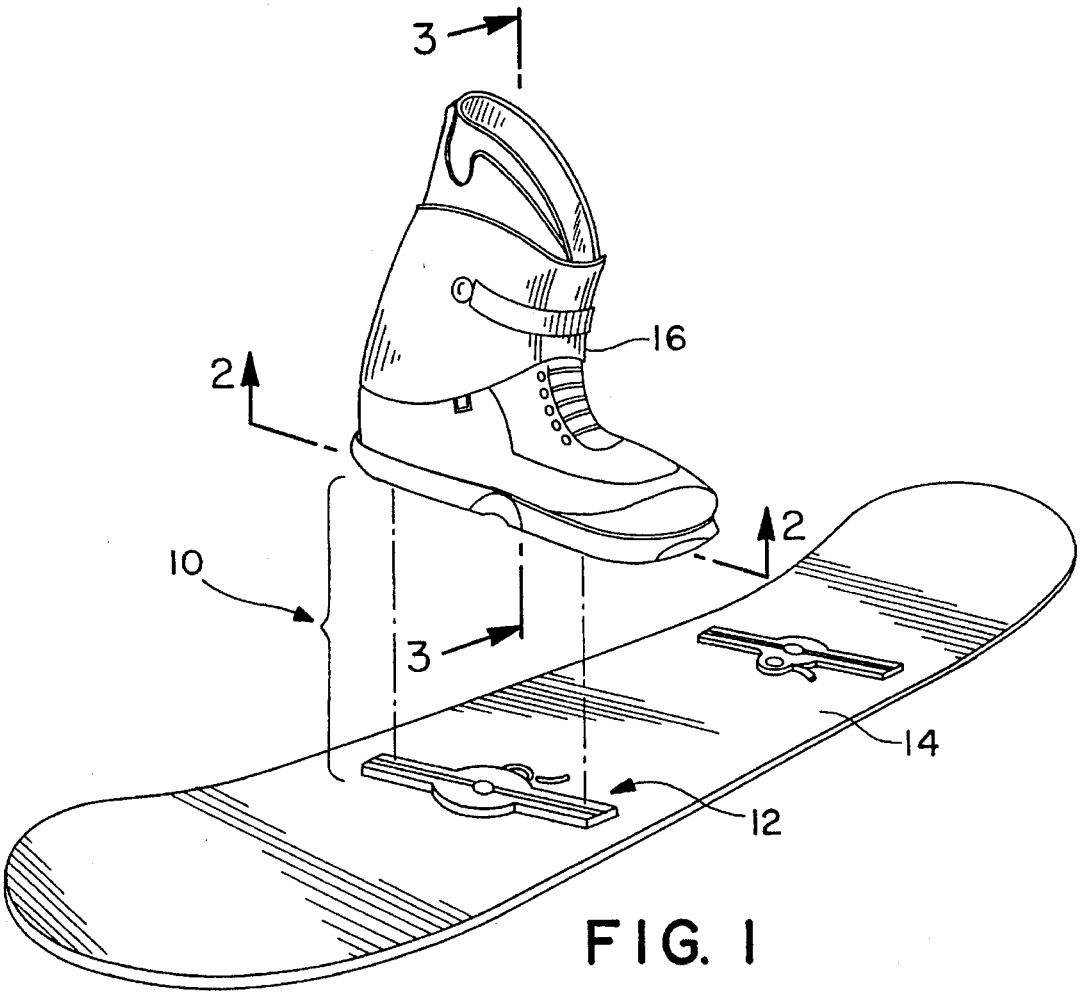
FIG. 1 is a perspective view of a boot and binding snowboard assembly of the present invention.

Referring to the drawings more particularly by reference numbers, FIG. 1 shows a boot and binding snow board assembly 10 of the present invention. The assembly includes a binding 12 that is attached to a snowboard 14 and a boot 16 that is worn by a snowboarder. The boot 16 is releasably attached to the snowboard 14 by the binding 12. Each snowboard typically has two bindings 12 that are coupled to a pair of boots 16.

Figure 2:
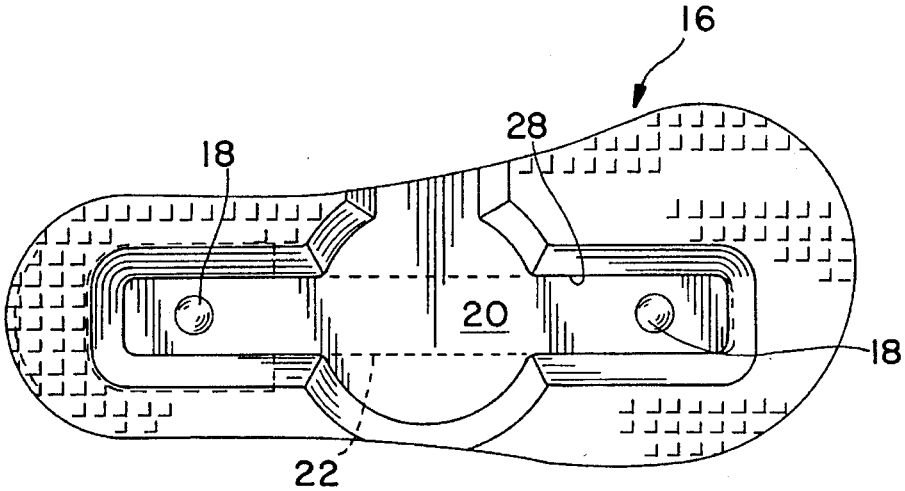
FIG. 2 is a bottom view of the boot.
Figure 3:
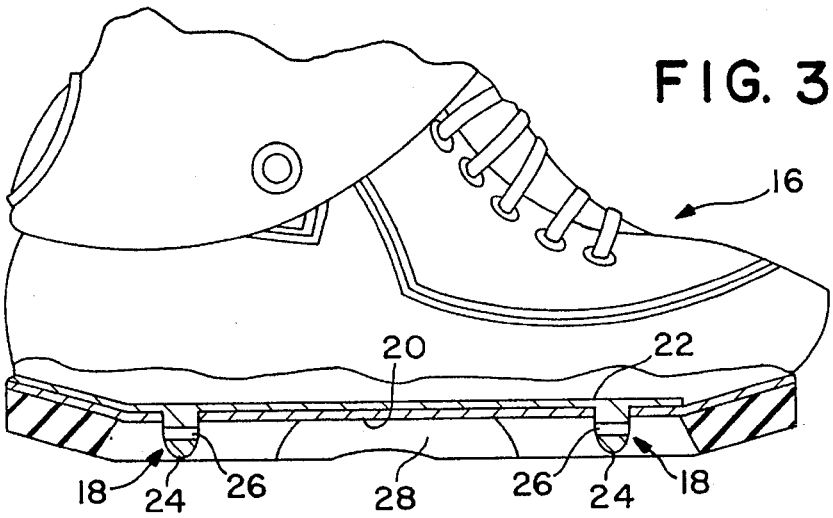
FIG. 3 is a cross-sectional view of the boot.

As shown in FIGS. 2 and 3, each boot 16 has a pair of locating pins 18 that extend from a bottom surface 20 of the boot 16. The pins 18 are preferably constructed from a relatively strong steel material and are integrally formed with plates 22. The plates 22 are typically molded into the sole of the boot 16. Each pin 18 has a conical tip 24 and an aperture 26 which extends through the thickness of the pin material.

Figure 4:
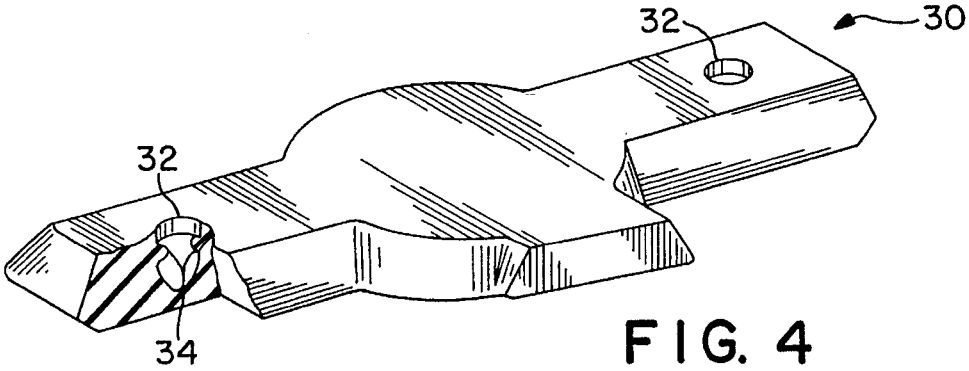
FIG. 4 is a perspective view of an insert for the boot.

The pins 18 are located within a recess 28 of the boot 16. The recess 28 allows the snowboarder to walk on the flat portion of the boot 16. As shown in FIG. 4, the boot 16 may have an insert 30 that can be pressed into the recess 28 to fill the same. The insert 30 has a pair of holes 32 that receive the pins 18. The holes 32 may each have a pair of protrusions 34 that extend into the pin apertures 26. The insert 30 is typically constructed from the same rubber or hard plastic material as the sole of the boot 16. The bottom surface of the insert 30 may have traction features that also correspond to the boot sole. The insert 30 increases the traction of the boot 16, and prevents snow from entering the recess 28 and the pin apertures 26 when the snowboarder is walking on snow.

Figure 5:
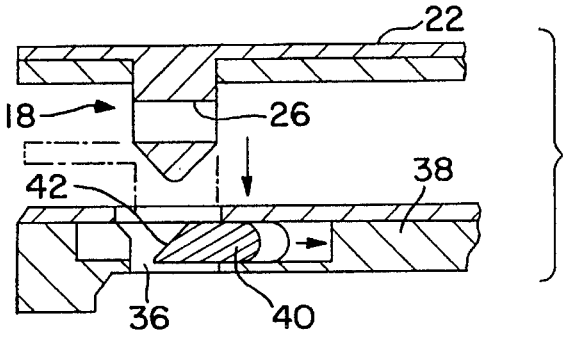
FIG. 5 is a sectional view showing a locating pin being inserted into a binding which has a locking pin.
Figure 6:
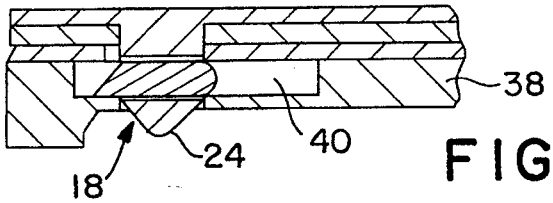
FIG. 6 is a cross-sectional view similar to FIG. 5 showing the locking pin extending through an aperture of the locating pin.

As shown in FIGS. 5 and 6, the locating pins 18 can be inserted into corresponding pin holes 36 of a binding housing 38. Within each hole 36 is a locking pin 40 that extends through the entire length of the locating pin apertures 26. Inserting the locking pin 40 through the entire pin aperture 26 doubles the shear strength of the pin 40.

The conical tips 24 of the locating pins 18 engage cam surfaces 42 of the locking pins 40 to move the locking pins 40 in the direction indicated by the arrow as shown in FIG. 5. Movement of the locking pins 40 allow the locating pins 18 to be fully inserted into the holes 36, so that the locking pins 40 can move into the apertures 26 as shown in FIG. 6. The boot 16 is secured to the binding and the snowboard when the locking pins 40 extend through the pin apertures 26. The locking pins 40 are preferably constructed from a relatively strong steel material.

Figure 7:
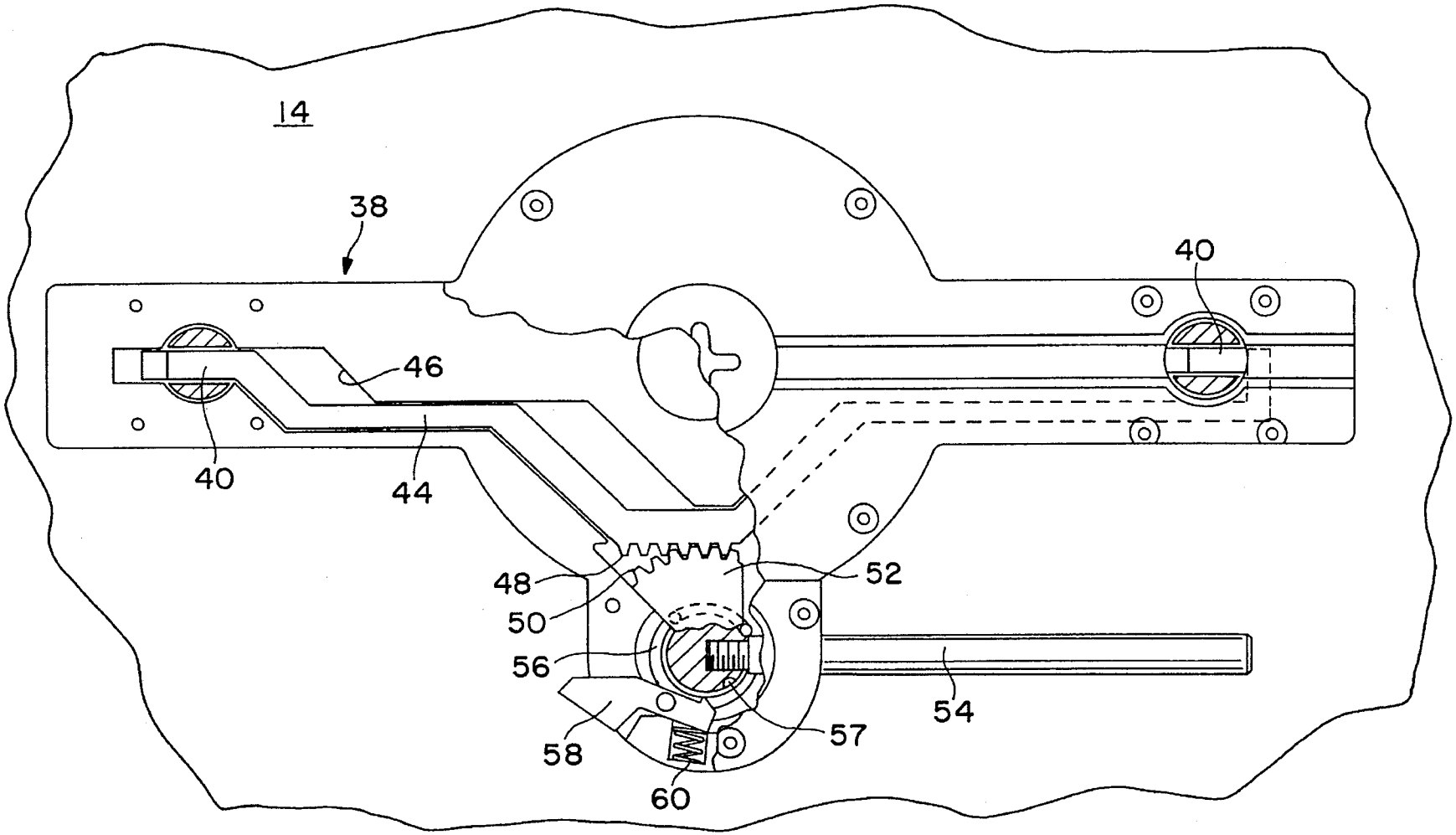
FIG. 7 is a top sectional view of the binding showing the locking pins in a locking position.

As shown in FIG. 7, the locking pins 40 are integrally formed with an armature 44 that is located within a channel 46 of the binding housing 38. The channel 46 is constructed to allow the armature 44 and pins 40 to move between a lock position and a release position.

The armature 44 has gear teeth 48 that are coupled to corresponding gear teeth 50 of a planetary gear 52. The planetary gear 52 has a lever 54 that extends from the binding housing 38. Rotating the lever 54 rotates the planetary gear 52 and moves the locking pins 40 between the release and lock positions.

Coupled to the binding housing 38 and the planetary gear 52 is a torsion spring 56. The torsion spring 56 biases the planetary gear 52 and pins 40 into the lock position. The planetary gear 52 contains a slot 57 that receives the tip of a latch 58 when the lever 54 is rotated in a clockwise direction. The latch 58 maintains the locking pins 40 in the release position when the latch tip engages the gear slot 57. A compression spring 60 pushes the tip of the latch 58 into continuous engagement with the planetary gear 52, so that the latch tip is pushed into the gear slot when the lever 54 is rotated. The latch tip can be released from the planetary gear 52 by pushing the latch with a force sufficient to overcome the force of the spring 60.

In operation, the locking pins 40 are initially in the locking position. To fasten the boot 16 to the board 14, the snowboarder inserts the locating pins 18 into the binding holes 36. As shown in FIGS. 5 and 6, insertion of the pins 18 into the holes 36 moves the locking pins 40 out to the released position and back into the lock position, wherein the pins 40 extend through the apertures 26 and secure the boot 16 to the board 14.

Figure 8:
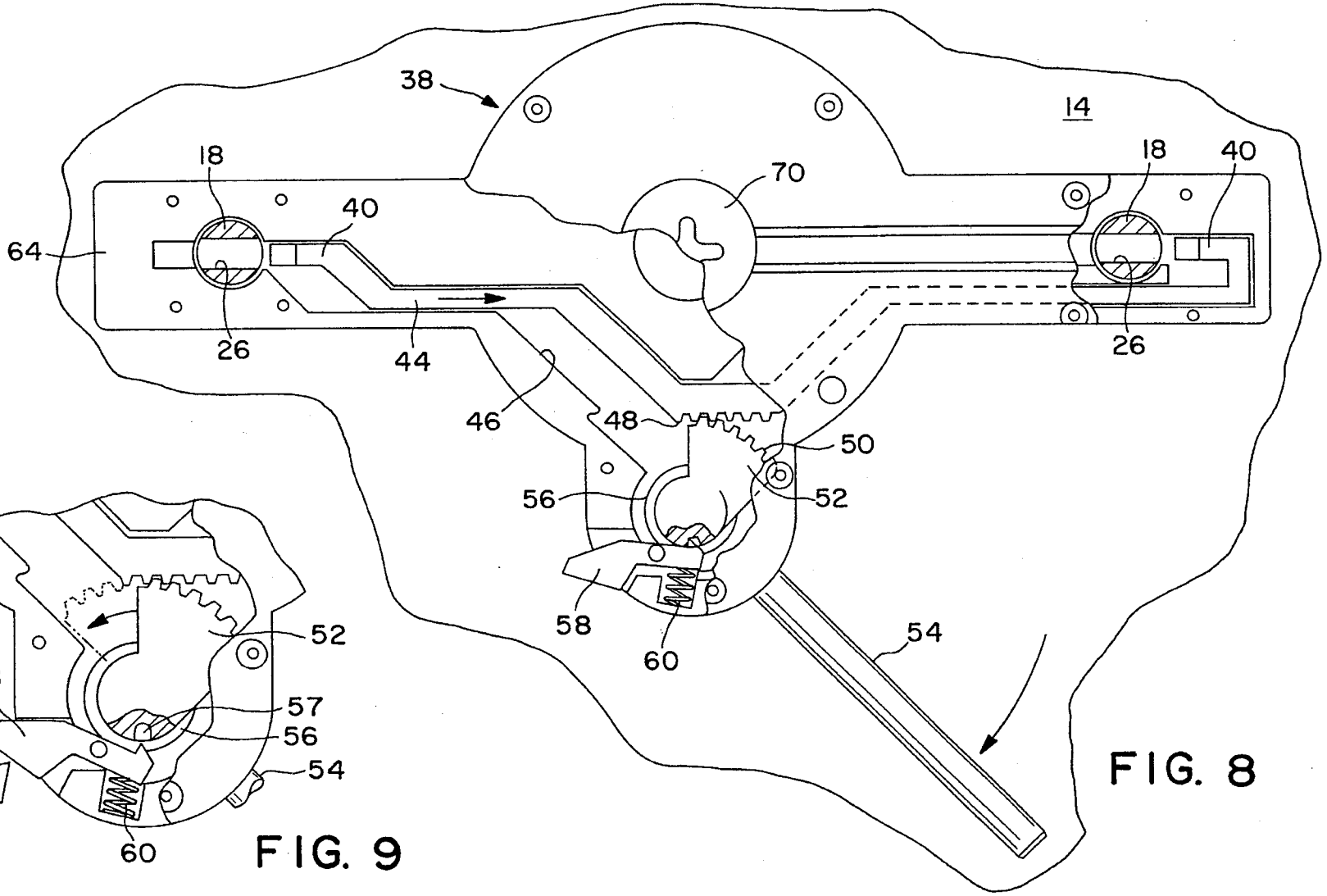
FIG.8 is a top sectional view of the binding showing the locking pins moved into a release position upon rotation of a lever.

The snowboarder can release the boot 16 from the board 14 by rotating the lever 54. As shown in FIG. 8, rotation of the lever 54, rotates the planetary gear 52 and moves the locking pins 40 out of the apertures 26 and into the release position. The latch 58 maintains the pins 40 in the release position, so that the snowboarder can remove the boot 16 from the binding without having to hold the lever 54 in the rotated position.

Figure 9:
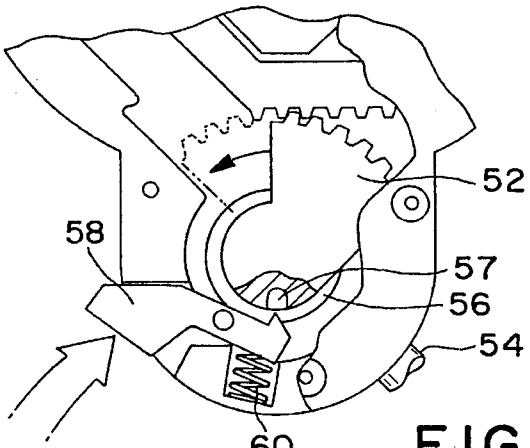
FIG. 9 is a top sectional view similar to FIG. 8, showing a latch released from the lever.

As shown in FIG. 9, to reset the binding, the user can push the latch 58 to release the planetary gear 52, wherein the torsion spring 56 rotates the gear 52 and moves the pins 40 back to the lock position.

Figure 10:
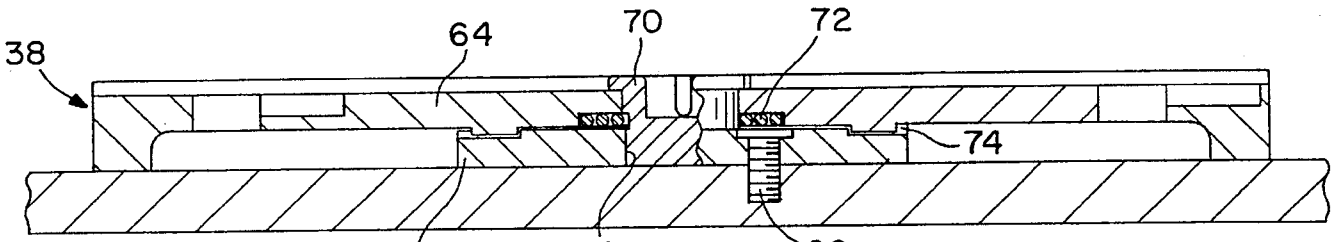
FIG. 10 is a section view of the binding housing.
Figure 11:
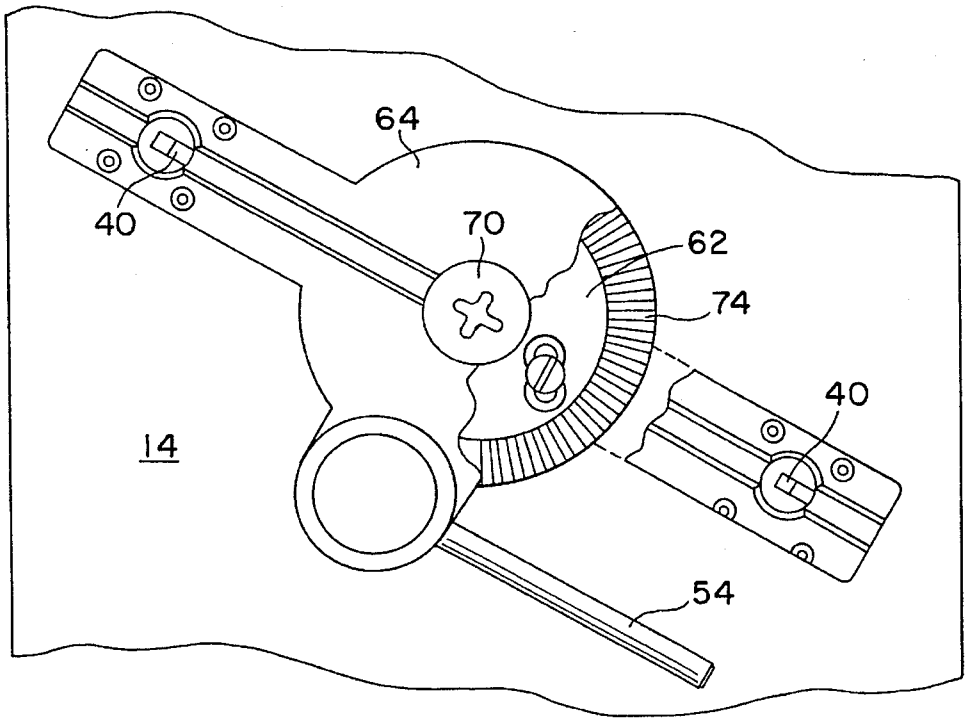
FIG. 11 is a top view showing a cover plate of the binding housing rotated relative to the base plate.

As shown in FIGS. 10 and 11, the binding housing 38 is preferably constructed from a base plate 62 and a cover plate 64. The base plate 62 is mounted to the board 14 by mounting screws 66. The plate 62 may have four sets of holes, three holes per set, that allow the plate 62 to be moved to different locations on the board 14. The base plate 62 has a threaded portion 68 that receives a tie-down bolt 70 which couples the cover plate 64 to the base plate 62. Located between the base plate 62 and the cover plate 64 is a conical spring 72 which biases the cover plate 64 away from the base plate 62. The cover 64 and base 62 plates each have meshing teeth 74 that prevent plate 64 rotation. The plate 64 is preferably constructed from aluminum. The tie-down bolt 70 and plate 64 are preferably constructed from titanium to increase the thread strength therein.

In operation, to rotate the binding 12 relative to the board 14, the user can unscrew the tie-down bolt 70 so that the spring 72 moves the teeth of the cover plate 64 out of engagement with the base plate 62. The snowboarder can then rotate the binding 12 relative to the board 14. The binding 12 is fixed in the new position by screwing the bolt 70 down into the base plate 62. Rotating the binding allows the user to move the position of his feet relative to the board 14.

Figure 12:
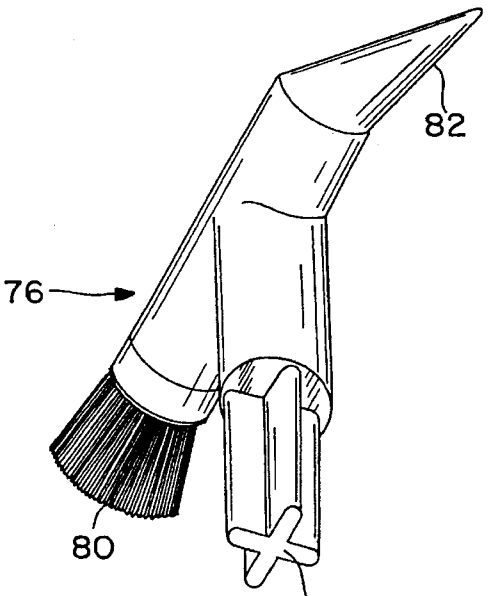
FIG. 12 is a perspective view of a multi-functional tool that can unscrew a tie-down bolt of the binding housing assembly.

As shown in FIG. 12, the tie-down bolt 70 may be operated with a tool 76 which has an end 78 that can be inserted into the head of the bolt 70 to rotate the same. The tool 76 may also have a brush 80 to wipe off snow from the boot 16 and binding 12, and a pick 82 to remove packed snow. What is thus provided is an adjustable snowboard binding that can readily attach and release a boot 16 from a snowboard 14.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A binding mechanism for a snowboard, the snowboard being coupled to a boot that has a locating pin which extends from a bottom boot surface, the locating pin having an aperture that extends therethrough, comprising:

a binding housing that is mounted to the snowboard, said binding housing having a hole that receives the locating pin of the boot;

a locking pin that moves between a lock position wherein said locking pin extends into the locating pin aperture when the locating pin is inserted into said hole of said binding housing and a release position wherein said locking pin moves out of the locating pin aperture; and, a release assembly that moves said locking pin between the release and lock positions.

2. The binding mechanism as recited in claim 1, wherein said release assembly includes a lever that can be rotated to move said locking pin into the release position.

3. The binding mechanism as recited in claim 2, further comprising an armature that couples together a pair of locking pins and which has gear teeth that mesh with corresponding gear teeth of said lever to move said locking pins when said lever is rotated.

4. The binding mechanism as recited in claim 2, wherein said release assembly includes a latch that engages said lever and maintains said locking pin in the release position.

5. The binding mechanism as recited in claim 4, wherein said release assembly includes a spring that biases said locking pin into the lock position.

6. The binding mechanism as recited in claim 4, wherein said release assembly includes a spring that biases said latch into engagement with said lever.

7. The binding mechanism as recited in claim 1, wherein said binding housing includes a base plate that is mounted to the snowboard and a cover plate that contains said locking pin and said release assembly, and is coupled to said base plate so that said cover plate can be rotated relative to the snowboard.

8. The binding mechanism as recited in claim 7, wherein said binding housing includes a tie-down bolt that couples said cover plate to said base plate and a spring that biases said cover plate away from said base plate.

9. A boot/binding assembly for a snowboard, comprising:

a boot that has a sole;

a locating pin that extends from said sole, said pin having an aperture;

a binding housing that is mounted to the snowboard, said binding housing having a hole that receives said locating pin of said boot;

a locking pin that moves between a lock position wherein said locking pin extends into said locating pin aperture when the locating pin is inserted into said hole of said binding housing, and a release position wherein said locking pin moves out of said locating pin aperture; and, a release assembly that moves said locking pin between the release and lock positions.

10. The assembly as recited in claim 9, wherein said release assembly includes a lever that can be rotated to move said locking pin into the release position.

11. The assembly as recited in claim 10, further comprising an armature that couples together a pair of locking pins and which has gear teeth that mesh with corresponding gear teeth of said lever to move said locking pin when said lever is rotated.

12. The assembly as recited in claim 10, wherein said release assembly includes a latch that engages said lever and maintains said locking pin in the release position.

13. The assembly as recited in claim 12, wherein said release assembly includes a spring that biases said locking pin into the lock position.

14. The assembly as recited in claim 12, wherein said release assembly includes a spring that biases said latch into engagement with said lever.

15. The assembly as recited in claim 9, wherein said binding housing includes a base plate that is mounted to the snowboard and a cover plate that contains said locking pin and said release assembly, and is coupled to said base plate so that said cover plate can be rotated relative to the snowboard.

16. The assembly as recited in claim 15, wherein said binding housing includes a tie-down bolt that couples said cover plate to said base plate and a spring that biases said cover plate away from said base plate.

17. The assembly as recited in claim 9, wherein said pin is located within a recess of said boot.

18. The assembly as recited in claim 17, further comprising an insert that can be inserted into said recess to cover said pin.

* * * * *